United States Patent [19]

Corica

[11] Patent Number: 4,929,208

[45] Date of Patent: May 29, 1990

[54] SURFBOARDS FOR DOING AERIALS

[76] Inventor: Joseph P. Corica, 2308 Altisma #222, Carlsbad, Calif. 92008

[21] Appl. No.: 334,344

[22] Filed: Apr. 7, 1989

[51] Int. Cl.[5] ..... A63C 15/00

[52] U.S. Cl. ..... 441/75

[58] Field of Search ..... 114/39.1, 39.2; 441/74, 441/75, 65, 66, 68

[56] References Cited

U.S. PATENT DOCUMENTS

| | | | |
|---|---|---|---|
| D. 265,116 | 6/1982 | Churchill | 441/74 |
| 3,802,011 | 4/1974 | Castagnola | 441/75 |
| 4,267,615 | 5/1981 | Nealy | 441/75 |
| 4,592,734 | 6/1986 | Metiver | 441/74 |
| 4,619,619 | 10/1986 | Muse, Jr. | 441/74 |
| 4,645,466 | 2/1987 | Ellis | 441/74 |
| 4,730,568 | 3/1988 | Campbell | 441/74 |

*Primary Examiner*—Joseph F. Peters, Jr.

*Assistant Examiner*—Jesüs D. Sotelo

*Attorney, Agent, or Firm*—Duane C. Bowen

[57] ABSTRACT

An elastic strap, housed in a well in the upper surface of a surfboard, is pulled on by a surfer to press the surfboard against his feet to facilitate doing aerials with the surfboard. When pulled by the surfer the strap has a length, in elonagated condition, sufficient for the surfer to hold the strap while standing. The well is located rearward of the center of the surfboard in the area where the surfer stands and the well extends longitudinally of the surfboard. The strap is secured by Velcro fasteners to rods secured in the well and the strap is secured to and wrapped around at least three rods so that the strap can be longer than if its ends were simply secured in the ends of the wall. A pliable handle is located centrally of the strap. A cover removably fits over the well so that the strap and handle are covered when not in use.

13 Claims, 2 Drawing Sheets

SURFBOARDS FOR DOING AERIALS

BRIEF SUMMARY OF THE INVENTION, BACKGROUND AND OBJECTIVES

My invention concerns modification of a surfboard so that a surfer can do aerials.

One derivation of the expression "aerial" is from skateboards when maneuvers are conducted on skateboards elevated from the supporting surface or terra firma. When used in connection with surfboards the expression "aerial" means maneuvers conducted when the surfboard is elevated relative to the supporting water or wave.

In the past surfers have desired to do aerials but largely have been unsuccessful. They have tried to elevate or maneuver the surfboard by grasping a side edge of a surfboard, in the same manner that skateboarders have elevated and maneuvered skateboards by grasping a side edge of the skateboard. The maneuvers that skateboarders have been able to accomplish border on the unbelievable. However, using the same tactic with a surfboard has not worked out partly because the surfboard is a very unstable platform supported on an unstable medium. The surfboard is hard enough to control when the surfer assumes his normal mobile positions with the legs somewhat bent and with the feet disposed on a line diagonal of the surfboard. To grasp the side of the surfboard, the surfer would have to assume more of a crouch, the surfer would have to maintain a more static position, probably the feet would be disposed more fore and aft of each other, and the body would be unbalanced toward the surfboard edge being grasped.

My approach is to provide a flexible, elastic tension assembly of such length that it can be grasped to press the surfboard against the feet of the surfer while the surfer has a more or less normal position on the surfboard. The objectives of my invention include, generally, to adapt a surfboard for performing aerials and, more specifically, to provide such a flexible, elastic tension assembly of suitable length when pulled.

Further objectives include to provide an elastic assembly, to devise a tension member that will more or less retract into a well in the surfboard when not in use, to provide a central handle in the assembly, to permit lying on the assembly without discomfort, to provide a cover for the assembly when it is not in use, and to provide apparatus that is practical from the viewpoints of use, maintenance, cost, and practical manufacture.

My invention will be best understood, together with additional advantages and objectives thereof, when read with reference to the drawings.

DRAWINGS

SPECIFIC DESCRIPTION

Figure 1:
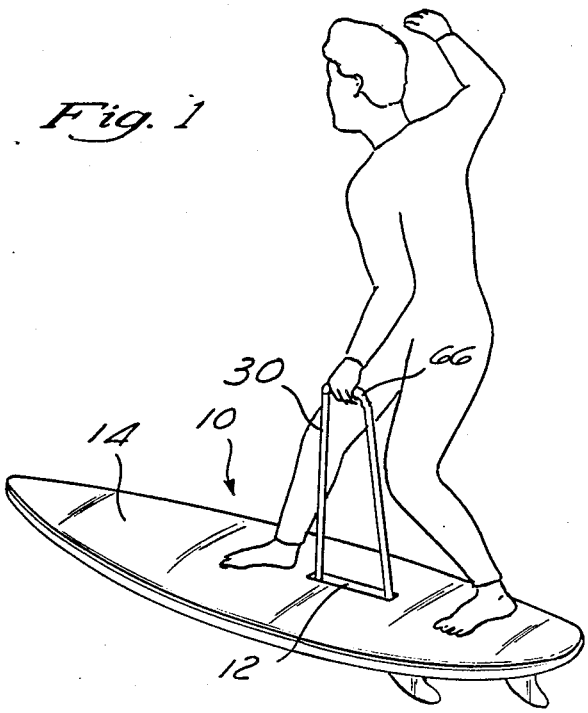
FIG. 1 is a perspective view of a specific embodiment of my new surfboard. A surfer is shown on the surfboard.
Figure 3:
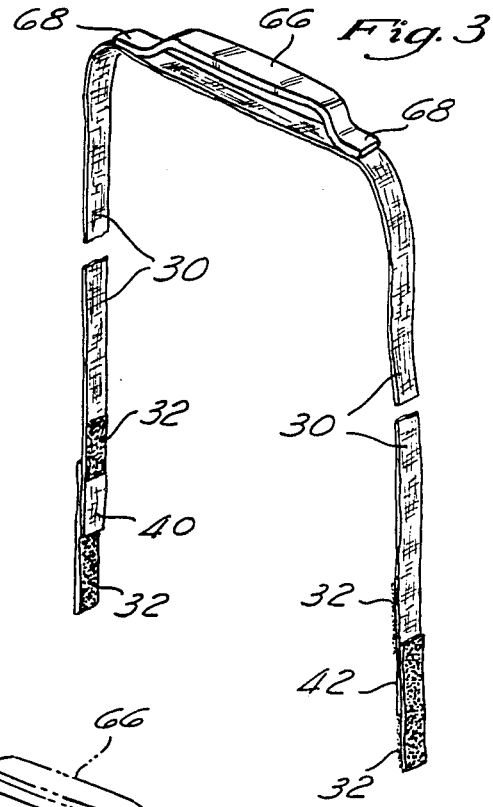
FIG. 3 is a perspective view of the strap by itself in vertically extended position.
Figure 4:
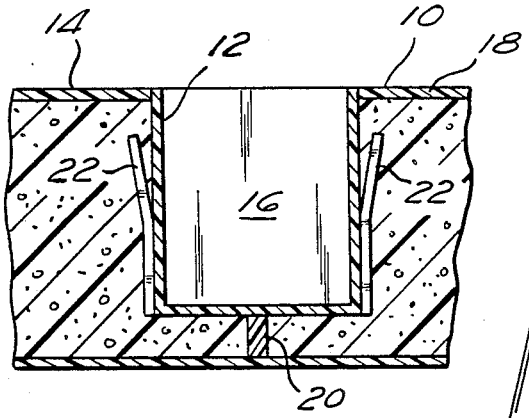
FIG. 4 is a fragmentary, enlarged elevational view, partly in cross-section.
Figure 2:
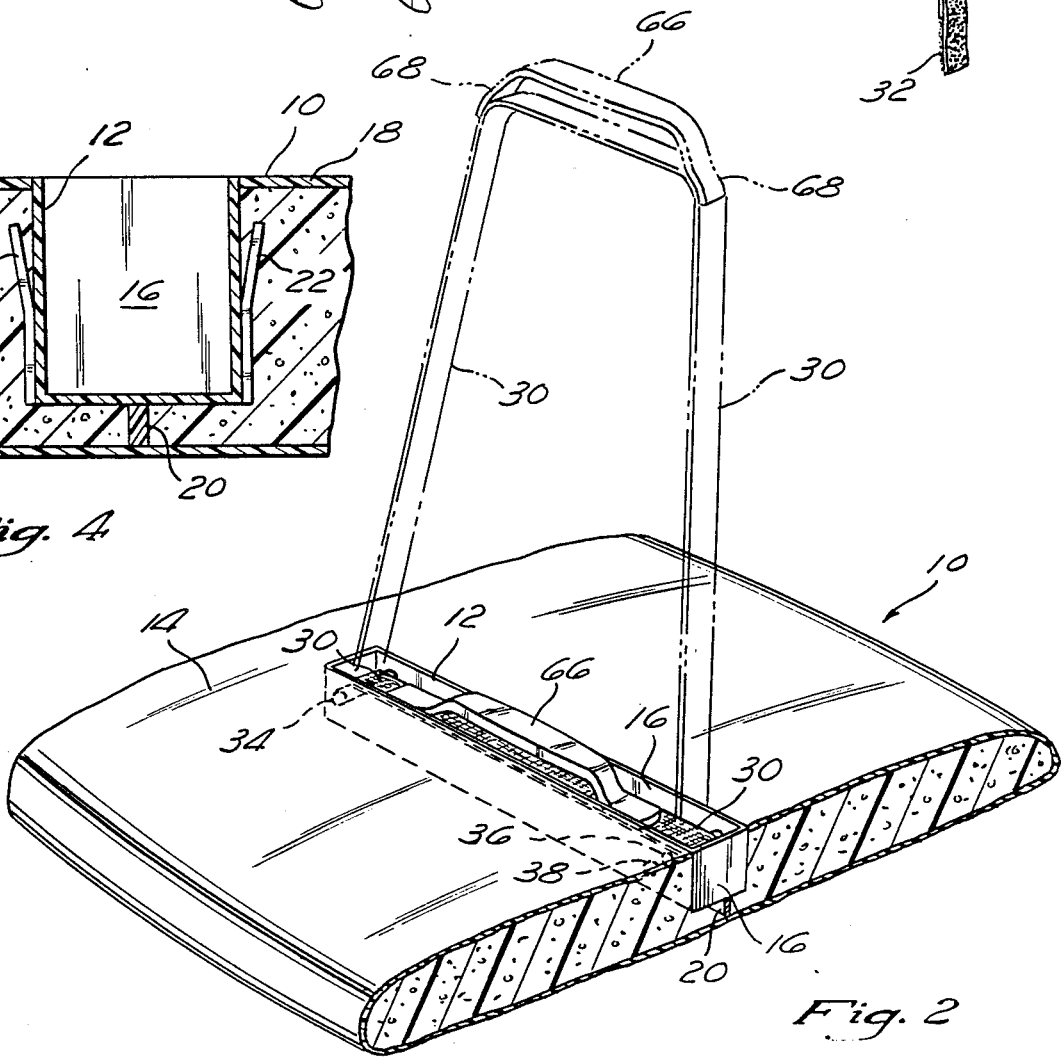
FIG. 2 is a perspective view of a section of the surfboard, shown partly in cross-section. The elastic strap is shown in vertically extended position in dashed lines.
Figure 5:
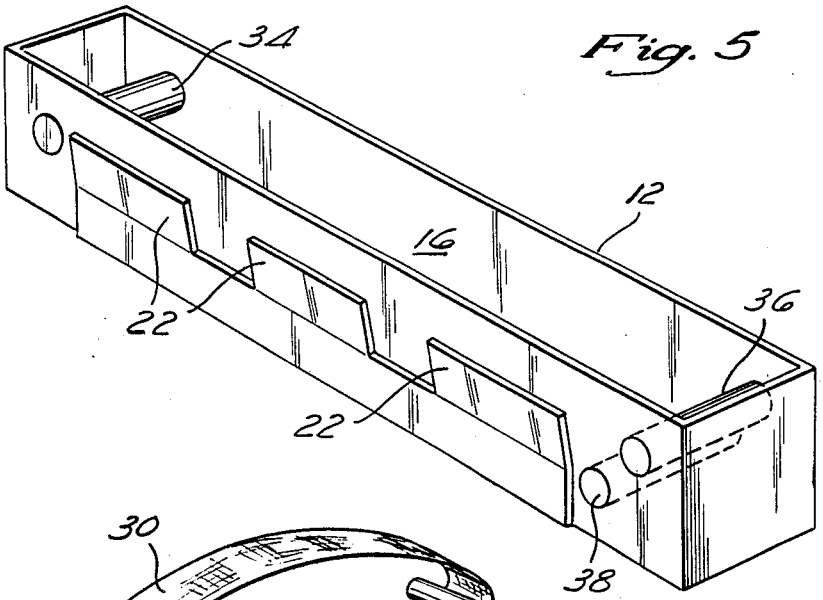
FIG. 5 is a perspective view of a box that forms a well in the surfboard.
Figure 6:
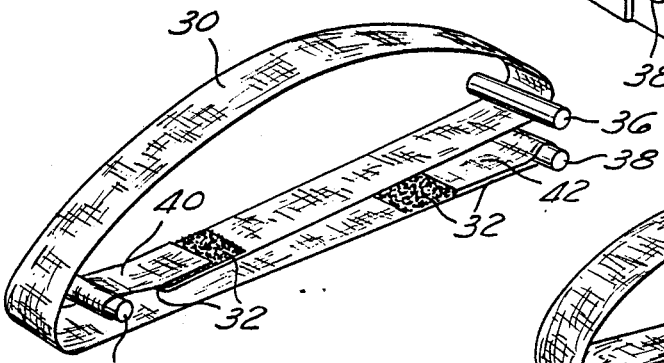
FIG. 6 is a perspective view showing how the strap is attached to rods and wound around the same.

The surfboard 10 depicted in the drawing is intended merely to be representative of surfboards of current manufacture and my invention is considered to be applicable to all models of surfboards, i.e., any board on which the surfer rides waves while standing on his feet.

I provide a well 12 in the upper surface 14 of surfboard 10. Preferably, well 12 is right-rectangular in shape and may be formed by a fiber-reinforced plastic box 16. Box 16 is embedded in the body of surfboard 10 which is formed of a fiber-reinforced foamed plastic. The upper edges of box 16 are disposed flush with the upper fiber-reinforced skin 18 of surfboard 10. Normally a surfboard will have a wood longitudinal rib 20 disposed in a vertical plane. Rib 20 is notched around box 16.

Preferably, box 16 has flange anchors 22, made of the same material as box 16, that flare away from the sides of box 16 as they extend upwardly to serve as anchors in the foamed material of surfboard 10. Other anchors could be substituted.

The purposes of well 12 include providing a receptacle and anchor for an elongated elastic strap 30. The strap 30 is to be grasped by a surfer on the board, so the location of strap 30, and hence the location and orientation of well 12, is of primary importance. Well 12 is disposed generally in the area of the surfboard upon which the surfer stands and is located rearward of the center of surfboard 10 longitudinally thereof. Well 12 is disposed generally centrally of surfboard 10 laterally thereof. Well 12 is elongated longitudinally of surfboard 10. As will be observed from FIG. 1, this location and orientation of well 12 positions strap 30 in the right location for the strap to be pulled upon by the surfer.

The length of strap 30 should be such that the middle will be at the right level for the surfer when he pulls surfboard 10 against his feet to do aerials or other high performance maneuvers. Different size surfers may use different length straps and different individuals of the same size may prefer somewhat different length straps, i.e., one surfer may bend his knees and body differently than another in performing aerials. The ends of each strap 30 have Velcro fasteners 32 and the straps can be interchanged or the straps can be readily changed in length by cutting an end of a strap 30 and relocating Velcro pads 32.

As before indicated, strap 30 is elastic, so its stretched length depends partly on its unstressed length, depends partly on the degree of elasticity, and depends partly on the degree of force used to stretch strap 30. Strap 30 can be made from any suitable elastomeric strap material. Preferably strap 30 will approximately double in length when pulled with the force a typical surfer can apply. The elastomeric material forming strap 30 should be resistant to salt water damage.

It is desirable that strap 30 mostly or entirely retract within well 12 when it is not in use so as to be out of the way when the surfer is lying flat on the board and when he shifts to a standing position. I facilitated such retraction by devising a way of using a longer strap than would be the case if the ends of strap 30 were merely secured to surfboard 10 or to the bottom of a well 12 in surfboard 10.

In FIGS. 5, 6, 7 and 2 I show the use of first, second and third rods 34, 36, 38 respectively. Box 16 can be injection molded with holes to accept the ends of rods 34, 36, 38 and the rods can be inserted into the holes and bonded in place. Strap 30 has a first end portion 40 attached by Velcro fasteners 32 to first rod 34 and wrapped about second rod 36. The second end portion 42 of strap 30 is attached by Velcro fasteners 32 to third rod 38 and wrapped about first rod 34 over first strap end portion 40. With this configurations, when a surfer pulls on the strap 30 centrally above well 12 there is approximately an equal amount of elasticity of strap 30 on each side of the portion of the strap the surfer grasps so that the grasped portion of the strap remains generally centered longitudinally of well 12 as the surfer pulls the surfboard against his feet. Another way of viewing the arrangement is that when strap 30 is attached to and wrapped about rods 34, 36, 38 as described, approximately the longitudinal center of strap 30 is centered relative to well 12 and will be grasped by the surfer when the surfer reaches toward the center of well 12.

The Velcro fasteners 32 also permit ready replacement of strap 30. It is recognized straps 30 will have limited lives in the surfing environment that includes exposure to salt water.

My invention was devised for high performance surfing, mainly for aerials. Surfers have attempted aerials for years with very little success. Foot straps have been tried many times for this purpose but foot straps have been quite unsuccessful. The reason for the failure is partly that surfers need to move their feet during surfing and the foot straps did not permit shifting of the feet. In conceived of the idea of the handheld elastic strap to permit a constant force to be applied to the board yet permitting shifting of feet. The purpose and usefulness of strap 30 is to keep pressure between the surfers feet and the upper surface 14 of surfboard 10.

Strap 30 also will be very beneficial for a beginning surfer. The beginning surfer can use strap 30 to do things an experienced surfer can do without strap 30. An analogy can be made to training wheels for bicycles.

Figure 8:
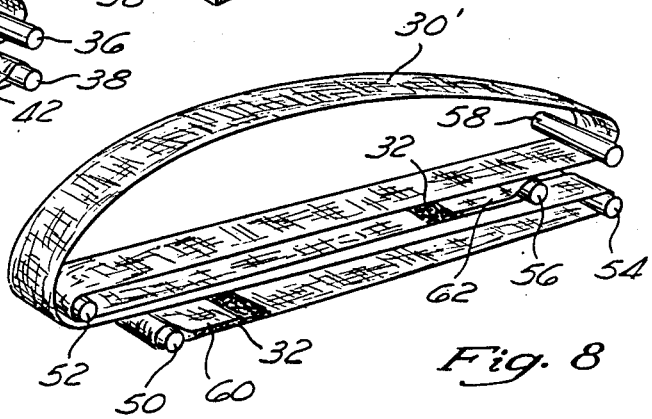
FIG. 8 is like FIG. 6 but involves five rods instead of three rods.
Figure 7:
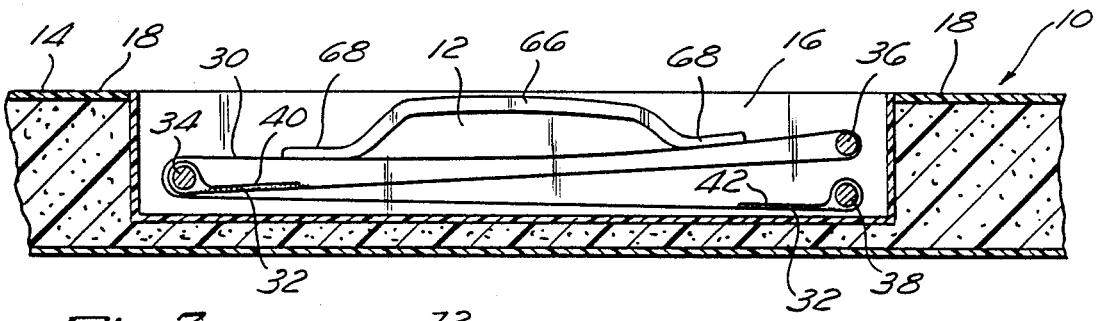
FIG. 7 is an elevational view, partly in cross-section, of the well area of the surfboard.
Figure 9:
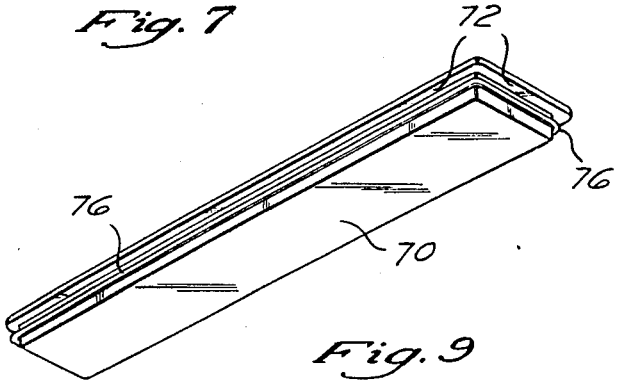
FIG. 9 is a perspective view of a cover for the well.
Figure 10:
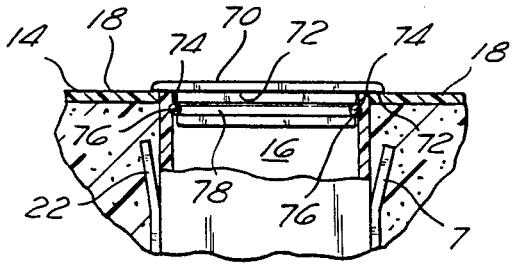
FIG. 10 is a fragmentary view, partly in cross-section, showing the cover covering the well.

A longer strap 30' can be used in the configuration shown in FIG. 8. First, second, third, fourth and fifth rods 50, 52, 54, 56, 58 respectively are fixed in box 16. First and second rods 50, 52 are disposed in a first end of well 12 with second rod 52 disposed at a higher level than first rod 50 and closer to the first end of well 12 than first rod 50. Third, fourth and fifth rods 54, 56, 58 are disposed in the second end 62 of well 12 with fourth rod 56 at a higher level than third rod 54 and with fifth rod 58 above fourth rod 56. Third and fourth rods 54, 58 are closer to the second end 62 of well 12 than fourth rod 56. The first end portion 60 of strap 30' is attached to first rod 50 and then wraps about third rod 54 and then wraps around second rod 52. The second end portion 62 of strap 30' is attached to fourth rod 56 and then wraps about second rod 52 and then wraps about fifth rod 58. In this way when a surfer on surfboard 10 pulls on the central portion of strap 30', there is an approximately equal amount of elasticity of strap 30' on each side of that central portion and the central portion of strap 30' remains generally centered longitudinally of well 12 as the surfer pulls the surfboard against his feet.

It will be observed from the above how I have provided an elastic strap 30 or 30' of sufficient length to be used as shown in FIG. 1 but which will automatically retract substantially or entirely into well 12 when not in use.

Strap 30 or 30' will be more easily usable if a handle 66 is provided. It can be formed of the same class of fiber-reinforced plastic as strap 30 or can be formed of a different plastic, but, in any case, handle 66 preferably is less flexible than strap 30. However, handle 66 should be sufficiently pliable so that the surfer can lie on the area of well, when paddling out to a wave, without discomfort from any protrusion of handle 66.

Handle 66 is elongated and extends longitudinally relative to well 12 and relative to the central portion of strap 30 to which it is attached. Handle 66 makes a reverse bend at each end 68 which is suitably secured to strap 30, such as by bonding, sewing, use of fasteners, or any combination thereof. In this way the central portion of handle 66 is spaced from strap 30 for convenience in a surfer grasping the same. Handle 66 serves several purposes, i.e., being less abrasive and more comfortable to hold than the surfer directly grasping strap 30, being adapted to more rapid engagement by the surfer's hand, being easier to locate visually or blindly, etc.

When the surfer doesn't desire to use strap 30 preferably a cover 70 is provided for well 12, to contain strap 30 and handle 66. This will get strap 30 and handle 66 out of the way when the surfer is lying on the board in paddling out to the wave area and out of the way of the surfer's feet when the surfer rises to a surfing position. Cover 70 can be formed in various ways, either flush with surfboard upper surface 14 or with an area including a flange 72 above surface 14. Various ways can be used to fasten cover 70 in place. The manner shown includes a groove 74 in the upper margin of well 12 and an O-ring 76 bonded into a groove 78 in cover 70. O-ring 76 latches into groove 74. Finger holes, not shown, in the upper surface of cover 70, can be used to grasp cover 70 for removal.

Having thus described my invention, I do not wish to be understood as limiting myself to the exact construction shown and described. Instead, I wish to cover those modifications of my invention that will occur to those skilled in the art upon learning of my invention and which are within the proper scope thereof.

I claim:

1. The improvement in an elongated surfboard, comprising:

(a) said surfboard having a well in its upper surface disposed generally in the area of the surfboard upon which a surfer stands and located rearward of the center of said surfboard longitudinally thereof and disposed generally centrally of said surfboard laterally thereof, said well having generally the shape of a box and being elongated longitudinally of said surfboard, (b) first, second, third, fourth and fifth rods disposed in said well and extending from side to side thereof and fixed in positions in said well, said first and second rods being disposed in a first end of said well with said second rod disposed at a higher level than said first rod and closer to said first end of said well than said first rod, said third, fourth and fifth rods being disposed in the second end of said well with said fourth rod above said third rod and with said fifth rod above said fourth rod, said third and fifth rods being closer to said second end of said well than said fourth rod, (c) an elongated elastic strap having its longitudinal center generally centered longitudinally of said well, said strap having a first end portion attached to said first rod and wrapping about said third rod and then wrapping about said second rod, said strap having a second end portion attached to said fourth rod and wrapping about said second rod and then wrapping around said fifth rod whereby when a surfer on said surfboard pulls on the central portion of said strap there is an approximately equal amount of elasticity of said strap on each side of said central portion and said central portion of said strap remains generally centered longitudinally of said well as the surfer pulls the surfboard against his feet, and (d) an elongated handle less flexible than said strap and extending longitudinally of said well and said handle making a reverse bend at each end thereof attaching to said strap, whereby the central portion of said handle is spaced from said strap for convenience in a surfer grasping the same.

2. The improvement in an elongated surfboard, comprising:

(a) said surfboard having a well in its upper surface disposed generally in the area of the surfboard upon which a surfer stands and located rearward of the center of said surfboard longitudinally thereof and disposed generally centrally of said surfboard laterally thereof, said well being elongated longitudinally of said surfboard, (b) first, second, third, fourth and fifth rods disposed in said well and extending from side to side thereof and fixed in positions in said well, said first and second rods being disposed in a first end of said well with said second rod disposed at a higher level than said first rod and closer to said first end of said well than said first rod, said third, fourth and fifth rods being disposed in the second end of said well with said fourth rod above said third rod and with said fifth rod above said fourth rod, said third and fifth rods being closer to said second end of said well than said fourth rod, and (c) an elongated elastic strap having its longitudinal center generally centered longitudinally of said well, said strap having a first end portion attached to said first rod and wrapping about said third rod and then wrapping about said second rod, said strap having a second end portion attached to said fourth rod and wrapping about said second rod and then wrapping around said fifth rod whereby when a surfer on said surfboard pulls on the central portion of said strap there is an approximately equal amount of elasticity of said strap on each side of said central portion and said central portion of said strap remains generally centered longitudinally of said well as the surfer pulls the surfboard against his feet.

3. The improvement in an elongated surfboard, comprising:

(a) said surfboard having a well in its upper surface disposed generally in the area of the surfboard upon which a surfer stands and located rearward of the center of said surfboard longitudinally thereof and disposed generally centrally of said surfboard laterally thereof, said well having generally the shape of a box and being elongated longitudinally of said surfboard, (b) first, second and third rods disposed in said well and extending from side to side thereof and fixed in positions in said well, said first rod being positioned in one end of said well and said second and third rods being positioned in the other end of said well with said second rod disposed at a higher level than said third rod, (c) an elongated elastic strap having its longitudinal center generally centered longitudinally of said well, said strap having a first end portion attached to said first rod and wrapping about said second rod and having a second end portion attached to said third rod and wrapping about said first rod over said first end portion of said strap whereby when a surfer on said surfboard pulls on the central portion of said strap there is an approximately equal amount of elasticity of said strap on each side of said central portion and said central portion of said strap remains generally centered longitudinally of said well as the surfer pulls the surfboard against his feet, and (d) an elongated handle less flexible than said strap and extending longitudinally of said well and said handle making a reverse bend at each end thereof attaching to said strap, whereby the central portion of said handle is spaced from said strap for convenience in a surfer grasping the same.

4. The improvement in an elongated surfboard, comprising:

(a) said surfboard having a well in its upper surface disposed generally in the area of the surfboard upon which a surfer stands and located rearward of the center of said surfboard longitudinally thereof and disposed generally centrally of said surfboard laterally thereof, said well being elongated longitudinally of said surfboard, (b) first, second and third rods disposed in said well and extending from side to side thereof and fixed in positions in said well, said first rod being positioned in one end of said well and said second and third rods being positioned in the other end of said well with said second rod disposed at a higher level than said third rod, and (c) an elongated elastic strap having its longitudinal center generally centered longitudinally of said well, said strap having a first end portion attached to said first rod and wrapping about said second rod and having a second end portion attached to said third rod and wrapping about said first rod over said first end portion of said strap whereby when a surfer on said surfboard pulls on the central portion of said strap there is an approximately equal amount of elasticity of said strap on each side of said central portion and said central portion of said strap remains generally centered longitudinally of said well as the surfer pulls the surfboard against his feet.

5. The surfboard of claim 4 in which said strap is attached to said first and third rods by Velcro fasteners.

6. The surfboard of claim 4 in which said surfboard is formed primarily by a foamed material and said well is formed by a box-shaped member and said box-shaped member having flanges that flare away from the sides of said box-shaped member as they extend upwardly to serve as anchors in said foamed material of said surfboard.

7. The surfboard of claim 4 in which there is an elongated handle extending longitudinally of said well and attached to said strap at each end thereof and spaced from said strap in the central portion of said handle to facilitate grasping by a surfer.

8. The surfboard of claim 7 in which said handle is less flexible than said strap and said handle is pliable so as to give under the weight of a surfer lying on said surfboard.

9. The surfboard of claim 4 in which there is a cover fitting over said well and secured thereto whereby said strap and well may be covered when said strap is not in use.

10. The improvement in an elongated surfboard, comprising:

(a) said surfboard having a well in its upper surface disposed generally in the area of the surfboard upon which a surfer stands and located rearward of the center of said surfboard longitudinally thereof and disposed generally centrally of said surfboard laterally thereof, said well being elongated longitudinally of said surfboard, and (b) an elongated flexible member having its ends secured in said well to be pulled on by a surfer to press said surfboard against his feet, said flexible member elongating under force and extending above said upper surface of said surfboard to a height convenient to be held by a surfer standing on said surfboard, said flexible member retracting into said well when it isn't grasped by a surfer.

11. The surfboard of claim 10 in which there is an elongated handle extending longitudinally of said well and attached to said flexible member at each end of said handle and attached centrally of said flexible member to facilitate grasping by a surfer, said handle being pliable so as to give under the weight of a surfer lying on said surfboard.

12. The surfboard of claim 11 in which there is a cover fitting over said well and secured thereto whereby said handle and said flexible member may be covered when not in use.

13. The improvement in an elongated surfboard, comprising:

(a) an elongated flexible member having its ends secured in said surfboard to be pulled on by a surfer to press said surfboard against his feet, said flexible member elongating under force and extending above the upper surface of said surfboard to a height convenient to be held by a surfer standing on said surfboard, said flexible member retracting when it isn't grasped by a surfer, (b) the ends of said flexible member being disposed generally in the area of the surfboard upon which a surfer stands and located rearward of the center of the surfboard longitudinally thereof and (c) an elongated handle attached to said flexible member at each end of said handle and attached centrally of said flexible member to facilitate grasping by a surfer, said handle being pliable so as to give under the weight of a surfer lying on said surfboard.

* * * * *